United States Patent [19]

Cunnington et al.

[11] 4,421,307

[45] Dec. 20, 1983

[54] FOLDING EXERCISING EQUIPMENT

[75] Inventors: Ian J. Cunnington, Grouville; Harold R. Evans, St. Brelade, both of Channel Islands

[73] Assignee: Tekron Licensing BV, De Leersum, Netherlands

[21] Appl. No.: 232,026

[22] PCT Filed: Jun. 4, 1980

[86] PCT No.: PCT/GB80/00097

§ 371 Date: Feb. 4, 1981

§ 102(e) Date: Jan. 27, 1981

[87] PCT Pub. No.: WO80/02647

PCT Pub. Date: Dec. 11, 1980

[30] Foreign Application Priority Data

Jun. 4, 1979 [GB] United Kingdom ..... 7919335

[51] Int. Cl.[3] ..... A63B 69/06

[52] U.S. Cl. ..... 272/72; 272/133; 272/143

[58] Field of Search ..... 272/72, 93, 116 R, 131, 272/132, 133, 134, 135, 136, 137, 138, 142

[56] References Cited

U.S. PATENT DOCUMENTS

| | | | |
|---|---|---|---|
| 693,701 | 2/1902 | Gossman | 272/72 |
| 1,205,426 | 11/1916 | Barnhill | 272/72 |
| 1,625,447 | 4/1927 | Benice | 272/72 |
| 1,650,417 | 11/1927 | Benniger . | |
| 1,782,728 | 11/1930 | Kiefer | 272/72 |
| 1,866,868 | 7/1932 | Thomson . | |
| 1,867,642 | 7/1932 | Woods . | |
| 1,905,092 | 4/1933 | Hardy . | |
| 1,974,445 | 9/1934 | Calleson | 272/72 |
| 2,251,120 | 7/1941 | Davis | 272/72 |
| 2,475,667 | 7/1949 | Jackson | 272/72 |
| 2,725,231 | 11/1955 | Hoover | 272/72 |
| 3,532,189 | 10/1970 | Wade | 272/131 X |
| 4,010,948 | 3/1977 | Deluty | 272/133 |
| 4,284,272 | 8/1981 | Evans et al. | 272/72 |

FOREIGN PATENT DOCUMENTS

| | | | |
|---|---|---|---|
| 547710 | 5/1956 | Belgium . | |
| 301954 | 11/1917 | Fed. Rep. of Germany . | |
| 2347029 | 3/1974 | Fed. Rep. of Germany | 272/72 |
| 806125 | 9/1936 | France . | |
| 819486 | 7/1937 | France . | |
| 1005855 | 1/1952 | France . | |
| 178577 | 7/1935 | Switzerland . | |
| 117216 | 7/1918 | United Kingdom . | |
| 290689 | 5/1928 | United Kingdom . | |
| 347533 | 4/1931 | United Kingdom . | |
| 356467 | 9/1931 | United Kingdom . | |
| 376851 | 7/1932 | United Kingdom . | |
| 389682 | 3/1933 | United Kingdom . | |
| 419982 | 11/1934 | United Kingdom . | |
| 438128 | 11/1935 | United Kingdom . | |
| 466901 | 6/1937 | United Kingdom . | |
| 484917 | 5/1938 | United Kingdom . | |
| 501525 | 2/1939 | United Kingdom . | |
| 607460 | 8/1948 | United Kingdom . | |
| 650009 | 2/1951 | United Kingdom . | |
| 658552 | 10/1951 | United Kingdom . | |
| 660060 | 10/1951 | United Kingdom . | |
| 1060281 | 3/1967 | United Kingdom . | |
| 1083705 | 9/1967 | United Kingdom . | |
| 1133927 | 11/1968 | United Kingdom | 272/72 |
| 1399853 | 7/1975 | United Kingdom . | |
| 2014052 | 8/1979 | United Kingdom | 272/72 |

*Primary Examiner*—Robert A. Hafer
*Assistant Examiner*—Arnold W. Kramer
*Attorney, Agent, or Firm*—Brumbaugh, Graves, Donohue & Raymond

[57] ABSTRACT

Exercising equipment of the rowing machine type having a frame, a footrest, a sliding seat, and a pivoted T handle. Work done by the user in pulling the handle backwards is dissipated by a flat strap, attached at one end to the handle and running back and forth over cylindrical guides to a spring loaded drum which maintains tension in the strap. The frame comprises front and rear portions which are connected by a hinged joint having a horizontal axis coincident with the pivot axis of the T handle. As a result, the frame is collapsible from an extended position in which the frame portions are end to end in alignment to a storage position in which they partially overlap. A hook at the top of the handle can be engaged under the front edge of the seat so as to hold the parts firmly in their folded position.

9 Claims, 5 Drawing Figures

FOLDING EXERCISING EQUIPMENT

FIELD OF THE INVENTION

This invention relates to exercising equipment, and more particularly to exercising machines which allow a user to simulate the action of rowing a boat.

THE PRIOR ART

Various rowing-type exercising machines have already been proposed. However, these previously-proposed machines have suffered from various disadvantages. Many of the prior machines have used a handle which is not constrained to follow any particular path, but is merely connected to the front end of the frame of the machine by a cord or tension spring. This means that the line of action of the force against which the user must work is much lower than in real rowing, so that the machine does not allow the user to simulate accurately a rowing action. Also, the fact that the handle is only loosely connected to the frame of the machine may make the machine somewhat inconvenient to store.

Also, the previously-proposed machines incorporate a frame which is in general fairly long, and this contributes to the awkwardness of storing the machine.

The present invention is concerned with providing a rowing-type exercise machine which is reasonably convenient to store, and does not have a loose handle.

SUMMARY OF THE INVENTION

According to the present invention, exercising equipment comprises an elongate frame, a foot rest mounted on the frame, a seat which is movable generally horizontally along the frame towards and away from the foot rest, and a handle mounted on the frame and arranged to be moved along a predetermined path by a user of the equipment, with at least a component of movement parallel to the direction of movement of the seat, and means arranged to oppose such movement of the handle, and the frame comprises front and rear portions which, in an operative position, lie generally in alignment and end to end, and, in a storage position, lie with their lengths at least approximately parallel, and at least partially overlapping.

The invention makes it possible to reduce the overall size of the exercising equipment for storage purposes.

Preferably, the two portions of the frame are interconnected by a hinge joint, so that the frame can be moved from its operative position to its storage position by a folding movement.

The means opposing movement of the handle is conveniently mounted entirely on the front portion of the frame, on which portion the foot rest is also mounted, while the rear portion of the frame provides a track for the movement of the seat.

The predetermined path along which the handle moves preferably lies well above the level of the seat, at least along part of the length of this path, in order that the exercise provided by the machine is a fairly close simulation of a rowing action. For example, the handle may comprise a bar which is pivoted at its lower end to the frame of the equipment, about a horizontal axis, and carrying a hand-grip at or near its upper end. Conveniently the pivot axis of the handle may coincide with the axis of the hinge joint connecting the two portions of the frame.

It may be possible so to arrange the lines of action of the various forces acting on the two portions of the frame that there is no tendency for relative movements to occur when the exercising equipment is in use. However, the preferred embodiment includes means arranged to prevent such relative movements of the two frame portions away from their operative position. It is also desirable that the frame portions of the equipment should be restrained from relative movements when in their storage position; in the case where the two frame portions are connected by a hinge joint, and the handle consists of a pivoted bar, the handle bar, in the storage position, may be restrained from movement by a hook arrangement connecting it to the rear frame portion, while the movement resisting means maintains a biassing force tending to move the handle bar relative to the front frame portion, which biassing force, on the one hand, keeps the hook arrangement under load, and, on the other hand, keeps the front frame portion pressed firmly against means limiting further folding movement of the frame portions.

The invention may be carried into practice in various ways, but one specific embodiment will now be described by way of example, with reference to the accompanying drawings, of which:

Figure 1:
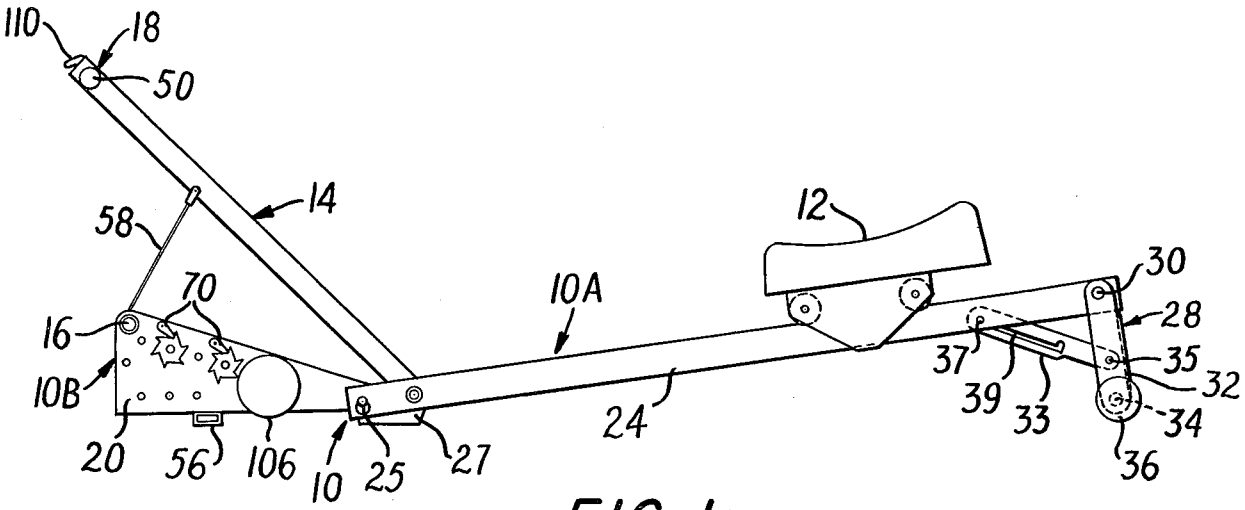
FIG. 1 is a side elevation of an exercising machine embodying the invention, in an operative position.
Figure 3:
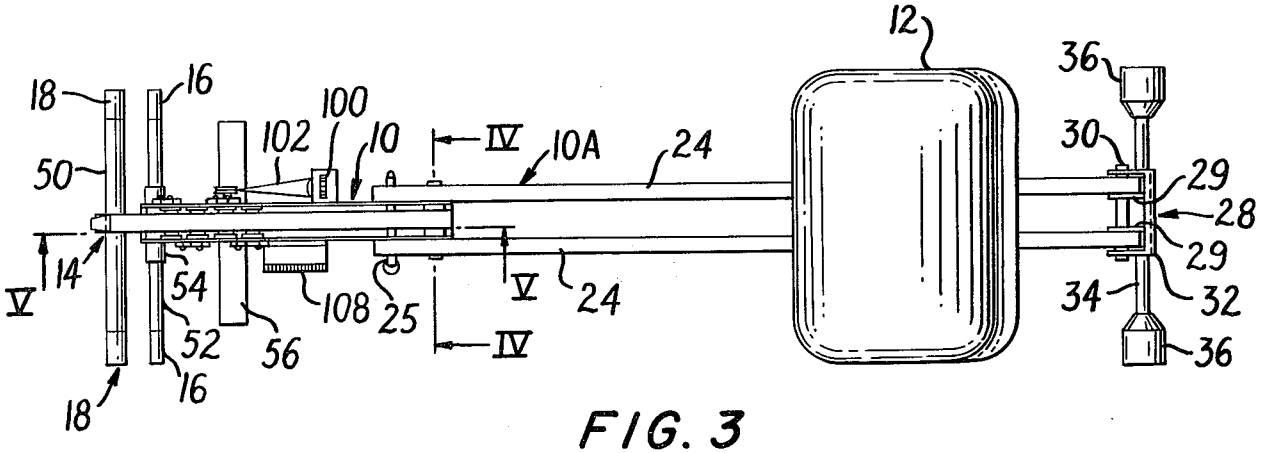
FIG. 3 is a plan view of the machine.

The exercise machine shown in the drawings consists essentially of a frame 10, a seat 12, and a pivoted handle 14 which can be moved against a resisting force. The frame 10 in turn consists of a rear portion 10A which provides a track along which the seat 12 can slide, and a forward portion 10B which houses a mechanism providing the force resisting movements of the handle 14. As will later be described in more detail, the two portions of the frame 10 are joined by a pivotal connection, so that the frame 10 can be folded to reduce its overall size, for storage purposes.

When the machine is in use, the user sits on the seat 12, with his feet on foot-rests 16 which form part of the forward portion 10B of the frame 10, and grasps two hand-grips 18 which form part of the handle 14. By straightening his legs and bending his arms and thereby pulling the handle 14, the user can simulate the action of rowing a boat, with each stroke of the handle being accompanied by a movement of the seat 12 along the rear portion 10A of the frame 10. After each stroke, the user returns to his previous position; the mechanism which provides the resistance to movement of the handle 14 assists the return movement of the handle, while the return movement of the seat 12 is assisted by the fact that the rear portion 10A of the frame is slightly inclined, so that the seat runs downhill during the return stroke. The construction of the exercise machine will now be described in greater detail.

Figure 4:
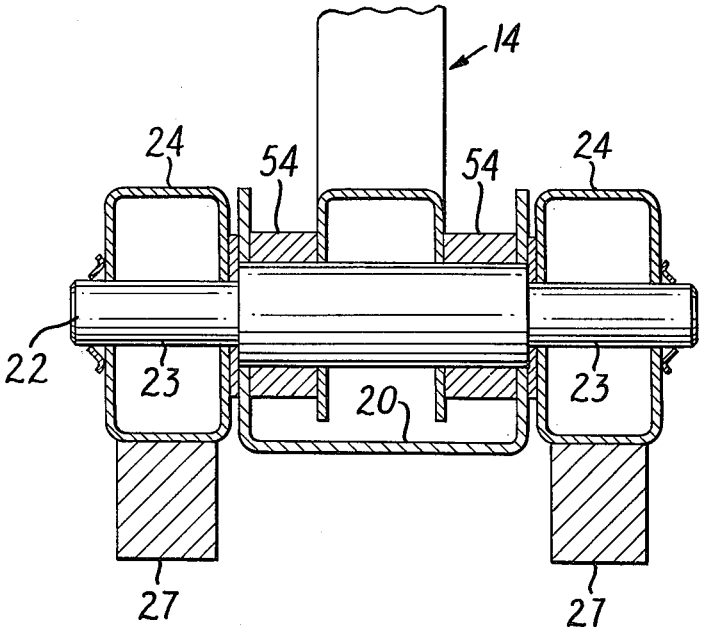
FIGS. 4 and 5 are sections, to an enlarged scale, taken on the lines IV—IV and V—V of FIG. 3.

The forward portion 10B of the frame includes a generally channel-shaped pressing 20, on which are mounted the various parts of the mechanism which provides the resistance to movement of the handle 14; this mechanism is concealed beneath a moulded plastics cover (not shown in the drawings). The rear portion 10A of the frame includes a pair of oblong section steel tubes 24, between which the rear part of the pressing 20 is received. The tubes 24 are interconnected near their front ends by a cross shaft 22 (see FIG. 4); a reduced-diameter portion 23 at each end of the shaft 22 is received in a transverse bore in the respective tube 24, and a spring clip is fitted to each end of the shaft 22, to keep the tubes 24 in place against the shoulders defining the inboard limits of the reduced-diameter portions. The cross shaft 22 also passes through holes in the two vertical walls of the pressing 20, between the tubes 24, thereby acting as a hinge pin connecting the two portions of the frame 10.

To lock the two portions of the frame 10 against relative movement in their operative position, as shown in FIG. 1, a locking pin 25 is provided, which passes through openings in the tube 24 and the vertical walls of the pressing 20, forward of the cross shaft 22. When the frame 10 is to be folded in its storage position (shown in FIG. 2), the locking pin 25 is manually withdrawn to allow the pressing 20 to hinge relative to the tubes 24.

The front end of each of the tubes 24 is supported by a plastics foot 27, secured to the underside of the tube. The rear ends of the tubes 24 are supported by a support 28 which is hinged to the tubes 24 by a cross shaft 30. The shaft 30 passes through transverse holes in the tubes 24; to maintain the correct spacing, between the tubes, a pair of collars 29 are pinned to the shaft 30, between the tubes 24. The support 28 consists of a prop portion 32, which extends almost vertically when the machine is in the operative position; the prop portion 32 is a shallow channel-shaped pressing, whose flanges lie one on each side of the rear portion 10A of the frame, thereby preventing the tubes 24 from moving apart. The cross shaft 30 extends through holes in the flanges at the top end of the prop portion 32, while a support bar 34 extends through and is fixed in holes in the flanges at the lower end of the prop portion 32. Each end of the support bar 34 is fitted with a round plastics foot 36, which forms the actual contact with the ground.

The support 28 can be pivoted about the shaft 30 from its operative position (FIG. 1) to a storage position (FIG. 2) in which it lies almost parallel to the tubes 24. To maintain the support in either of these positions, a channel-shaped strut 33, which is narrow enough to fit between the two tubes 24, is pivoted at one end to the prop portion 32 by a further cross shaft 35, passing through holes in the side flanges of the prop portion and the strut. The other end of the strut 33 is connected to the tubes 24 by a cross pin 37, which is fixed between the tubes 24, and passes through slots 39, one in each of the flanges of the strut 33. So that the support 28 is locked when the pin 37 is at either end of the slots 39, each slot has, at each of its ends, an upwards-extending end portion. Thus, when the pin 37 is at either end of the slots 39, the strut 33 will drop down, so that the pin 37 is received in the end portions of the slots 39, and the support 28 is locked until the strut 33 is manually lifted.

The seat 12 consists simply of a board provided on its upper surface with padding, and having attached to its underside a pair of brackets between which extend two transverse shafts each carrying a pair of rotatable flanged rollers which run on the upper surfaces of the frame tubes 24. In addition, the brackets are fitted with a pair of retaining lugs which co-operate with the undersides of the tubes 24 to keep the seat captive on the frame 10.

The pivoted handle 14 consists of a square steel tube having at its upper end a transverse bore which receives a round tubular handle bar 50, and having at its lower end a transverse bore by which it is pivoted on the cross shaft 22, between the vertical flanges of the pressing 20. Two spacer bushes 54 centralise the handle 14 between the flanges of the pressing 20. The handle bar 50 is rotatable in the bore in which it is received; this avoids the need for the user to allow his hands to slide around the handle bar in the course of a stroke.

As mentioned above, the channel-shaped pressing 20 forming the forward portion 10B of the frame carries the mechanism providing the resistance to movements of the handle 14. It also carries the foot-rests 16, which are formed by a single tube 52 fixed within a sleeve 54, which is in turn fixed at the front top corners of the flanges of the pressing 20. The pressing 20 also has, fixed to its underside, a transverse stabiliser 56, consisting of a rectangular section tube. When no forces are applied to the machine, and the machine is resting on a flat surface, the stabiliser is not quite in contact with the ground. However, clearances in the hinged joint between the two portions of the frame 10, may allow the forward portion 10B to move somewhat under the forces applied to the machine in operation, and the stabiliser 56 may then contact the supporting surface to limit these movements.

Figure 5:
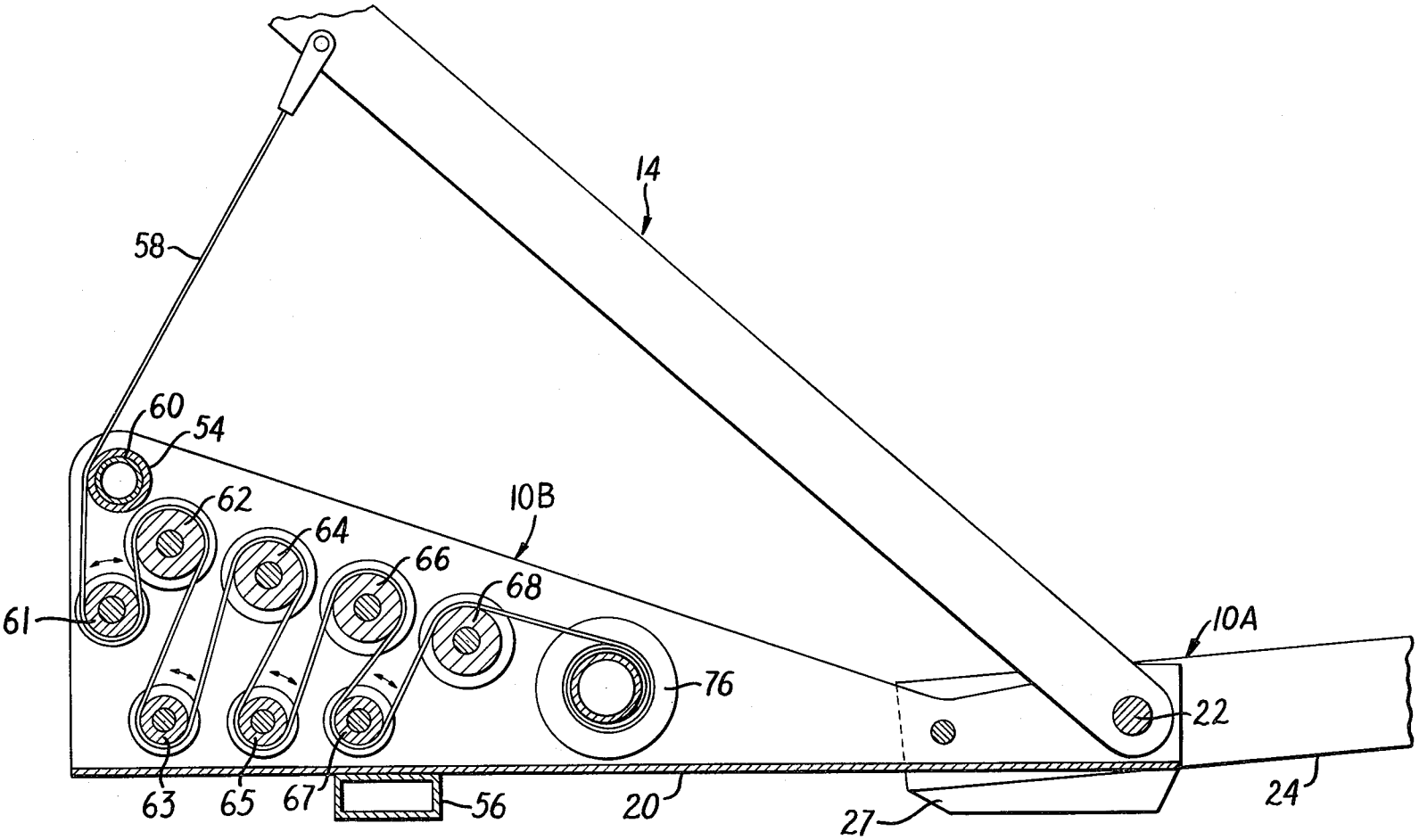

The mechanism which provides the resistance to rearwards movement of the handle 14 includes a tape 58 of nylon webbing, which emerges from an opening formed in the top of the plastics cover (not shown), and is then attached to the handle 14. The mechanism within the cover is illustrated in FIG. 5, and is so arranged that, as the handle 14 is moved rearwards, pulling the tape 58 out of the cover, the tension in the tape opposing movement of the handle is considerable, while when the handle is moved forwards again, the part of the tape attached to the handle 14 is under only a slight tension. To achieve this, the tape 58, after entering the cover, makes a part turn about each of a series of nine cylindrical or part-cylindrical guides 60 to 68. The first guide 60 is formed by the central portion of the sleeve 54, fixed right at the front of the pressing 20. The remaining guides guide the tape 58 in a serpentine path; the four guides 61, 63, 65 and 67 define the lower bights of this path, while the four remaining guides 62, 64, 66 and 68 define the upper bights of the serpentine path. Each of the guides 61, 63, 65 and 67 is formed by a roller which is freely rotatably mounted on a pivot shaft extending between the walls of the pressing 20. Each of the guides 62, 64, 66 and 68 is also formed by a roller, but these guides are each fixed to a shaft which is journalled in the side walls of the pressing 20, and whose rotation is controlled by a respective one of four ratchet mechanisms 70 (two visible in FIG. 1). The mechanisms 70 are individually controllable; each mechanism has a disengaged position, in which the associated roller is freely rotatable, and an engaged position, in which the roller is locked against anti-clockwise rotation (as seen in FIG. 1); this direction of rotation tends to occur as the handle 14 is moved rearwards. The rollers 62, 64, 66 and 68 are still free to turn clockwise as the handle 14 is moved forwards again. After leaving the guide 68, the tape 58 is wound up on a rotatable drum 76, which contains a clock-type spring arranged to maintain a tension in the tape, and is mounted on a pivot shaft extending between the flanges of the pressing 20.

In operation, the tension maintained in the tape by the spring-loaded drum 76 is magnified by the frictional sliding of the tape around those of the guides which remain stationary as the handle 14 is moved rearwards, thereby creating a considerable tension in the part of the tape attached to the handle. The magnitude of this tension can be adjusted by varying the number of ratchet mechanisms 70 which are engaged, thereby varying the number of guides around which the tape 58 has to slide frictionally. As the handle 14 is moved forwards again, all the guides except the guide 60 will rotate, so that there is only a little friction opposing the movement of the tape 58. The force exerted by the tape on the handle 14 will therefore be slightly less than the tension maintained in the tape by the spring biassing of the drum 76, which is in turn considerably less than the reaction force exerted by the tape on the handle 14 during rearwards movements of the handle.

The machine also includes a mechanical counter 100 arranged to integrate the movements of the handle made by the user of the machine. The counter is mounted on the right-hand flange of the pressing 20, and is driven by a belt and pulley drive 102 from the shaft on which one of the guides 62, 64, 66 or 68 is mounted. The counter 100 incorporates its own one-way ratchet mechanism, so that only clockwise movements of the shaft actuate the counter; it will be appreciated that such movements occur on the return stroke of the handle 14, irrespective of whether the associated ratchet mechanism 70 is engaged or disengaged, and the magnitude of these movements indicates the magnitude of the movement of the handle 14. Thus, the counter 100 indicates the total distance through which the handle 14 has been moved.

The machine also includes a timer 106, which, in conjunction with the counter 100, allows the user to assess the rate at which he is exercising. The timer 106 is mounted on the left-hand flange of the pressing 20, and incorporates a conventional clockwork mechanism. The timer also incorporates a thumb wheel 108 which is calibrated in minutes, and is used to wind up the timer for the required number of minutes. At the end of the set time period, a bell is sounded by the timer.

Figure 2:
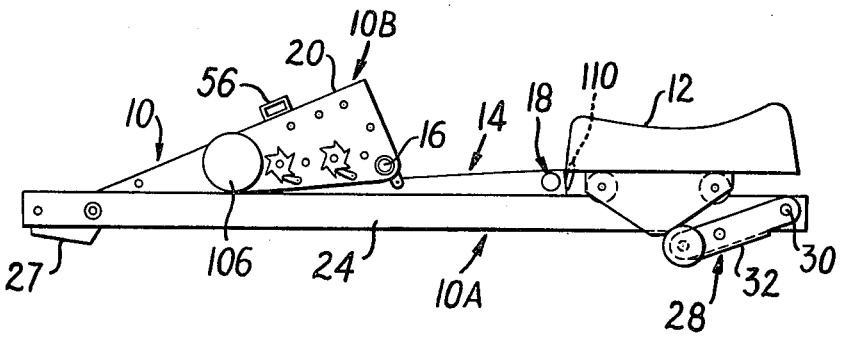
FIG. 2 is a view, similar to FIG. 1, but showing the machine in a storage position.

FIG. 2 illustrates the storage position of the machine. As previously described, when the machine is to be stored, the locking pin 25 is manually withdrawn, and the front portion 10B of the frame is folded upwards and over the rear portion 10A. This action also moves the handle 14 in the same manner, since the handle is pivoted on the same axis as the front portion 10B. The tension in the tape 58 tends to keep the handle 14 and the front frame portion 10B pressed firmly together during this movement. To allow this movement, the seat 12 has first to be moved to its rearmost position; this allows the top end of the handle 14 to move down close to the rear portion 10A of the frame. However, as the handle 14 and the front frame portion 10B move with one another towards this position, part of the front frame portion 10B will abut against the rear frame portion 10A, limiting the amount of pivoting movement of the front frame portion. When this occurs, the handle 14 is still a little way above the rear frame portion 10A; the handle can now be pressed down, against the tension in the tape 58, until it contacts the top of the tubes 24. A hook 110 is provided at the top of the handle, and this hook can now be engaged under the front edge of the seat 12, by moving the seat forward slightly. In this way, the parts are held firmly in their storage position, with the tension in the tape 58 tending to prevent relative movements.

We claim:

1. Exercising equipment comprising an elongate frame, a foot rest mounted on the frame near one end, a seat mounted on the frame at a distance from the foot rest, a handle arranged to be moved by a user of the equipment, and means arranged to oppose such movement of the handle in which the handle comprises a bar which is pivoted at one end to the frame about a horizontal axis transverse to the length of the frame, and carries a handgrip at or near its other end so that said handgrip is constrained to move in a predetermined path with at least a component of movement parallel to the length of the frame, in which the means opposing movement of the handle includes a flexible elongate friction element extending between the handle and the frame, a guide system over which the flexible element slides frictionally upon movement of the handle and tensioning means acting on the flexible element to oppose movement of the handle away from said foot rest, and in which the frame comprises front and rear portions which are connected together by a hinged joint having its axis horizontal and transverse to the length of the frame and close to the pivot axis of the handle so as to be collapsible from an operative position in which they lie generally in alignment and end to end and a storage position in which they partially overlap so as to substantially reduce their overall length.

2. Exercising equipment comprising an elongate frame, a foot rest mounted on the frame near one end, a seat which is movable along the frame towards and away from the foot rest, a handle which is arranged to be moved by a user of the equipment and means opposing such movement of the handle, in which the handle comprises a bar which is pivoted at one end to the frame about a horizontal axis transverse to the length of the frame and a handgrip at or near its other end thereby constraining the handgrip to move in a predetermined path with at least a component of movement parallel to the length of said frame, in which the means opposing movement of the handle includes a flexible elongate element extending between the handle and the frame and a guide system over which said flexible element passes, whereby, upon movement of said handle, the effective length of the flexible element between the handle and the frame varies and the flexible element slides frictionally over the guide system, and in which the frame is divided along its length into a front and rear portion and is provided with a hinged joint, connecting together the front and rear portions, whose axis is horizontal, transverse to the length of the frame, and close to the pivot axis of said handle, whereby said frame is collapsible from an operative position in which the two frame portions lie generally in alignment to a storage position in which the two frame portions overlap to a greater degree.

3. Equipment as claimed in claim 2 in which the pivotal axis of the handle coincides with that of the hinged joint between the portions of the frame.

4. Equipment as claimed in claim 2 in which the means opposing movement of the handle includes tensioning means which acts on the flexible element to oppose movements of the handle away from the front portion of said frame.

5. Equipment according to claim 4, wherein said guide system and said tensioning means are mounted on said front portion of said frame.

6. Equipment as claimed in claim 2 in which the foot rest is mounted on the front portion of the frame.

7. Equipment as claimed in claim 2 in which the rear portion of the frame provides a track for the movement of the seat.

8. Equipment according to claim 2, wherein said handle carries one portion of a retaining means, another portion of which is connected to said rear frame portion, the two portions of said retaining means engaging each other in the storage position of the equipment to restrain said handle against movement away from said rear frame portion while said means opposing movement of said handle maintains a biasing force tending to move said handle relative to said front frame portion, which biasing force, on the one hand, keeps said retaining means under load, and, on the other hand, keeps said front frame portion pressed firmly against means limiting further folding movement of said frame portions.

9. Equipment according to claim 8, wherein said other portion of said retaining means is part of said seat.

* * * * *